US010763577B2

(12) United States Patent
Gao et al.

(10) Patent No.: US 10,763,577 B2
(45) Date of Patent: Sep. 1, 2020

(54) ANTENNA SYSTEM FOR OPTIMIZING ISOLATION AND MOBILE TERMINAL

(71) Applicant: JRD COMMUNICATION (SHENZHEN) LTD, Shenzhen, Guangdong (CN)

(72) Inventors: Liye Gao, Guangdong (CN); Mingchao He, Guangdong (CN)

(73) Assignee: JRD COMMUNICATION (SHENZHEN) LTD, Shenzhen (CN)

( * ) Notice: Subject to any disclaimer, the term of this patent is extended or adjusted under 35 U.S.C. 154(b) by 0 days.

(21) Appl. No.: 16/333,231

(22) PCT Filed: Sep. 27, 2017

(86) PCT No.: PCT/CN2017/103632
§ 371 (c)(1),
(2) Date: Mar. 14, 2019

(87) PCT Pub. No.: WO2018/086424
PCT Pub. Date: May 17, 2018

(65) Prior Publication Data

US 2019/0229416 A1 Jul. 25, 2019

(30) Foreign Application Priority Data

Nov. 10, 2016 (CN) ..... 2016 1 0991317

(51) Int. Cl.
*H01Q 1/52* (2006.01)
*H01Q 1/24* (2006.01)
*H01Q 21/28* (2006.01)

(52) U.S. Cl.
CPC ..... *H01Q 1/521* (2013.01); *H01Q 1/243* (2013.01); *H01Q 21/28* (2013.01)

(58) Field of Classification Search
CPC ..... H01Q 1/521; H01Q 1/243
See application file for complete search history.

(56) References Cited

U.S. PATENT DOCUMENTS

2007/0229364 A1* 10/2007 Shor ..... H01Q 1/2291 343/700 MS
2008/0204347 A1* 8/2008 Alvey ..... H01Q 1/52 343/841
2010/0238072 A1* 9/2010 Ayatollahi ..... H01Q 1/48 343/700 MS
2011/0309992 A1 12/2011 Ali
2013/0293425 A1* 11/2013 Zhu ..... H01Q 1/243 343/702
2017/0012341 A1* 1/2017 Mai ..... H01Q 1/243

FOREIGN PATENT DOCUMENTS

CN 201345425 Y 11/2009
CN 104218327 A 12/2014
(Continued)

OTHER PUBLICATIONS

2nd Office Action of counterpart Chinese Patent Application No. 201610991317.5 dated Apr. 20, 2020.

*Primary Examiner* — Ernest G Tacsik

(57) ABSTRACT

The present disclosure provides an antenna system for optimizing isolation and a mobile terminal. The system defines clearance slots in an electromagnetic conductor and between antenna feed points for optimizing isolation between antenna units, and comprises clearance areas disposed on both sides of the electromagnetic conductor having the clearance slots of the circuit board for arranging the antenna feed points. Through the present disclosure, it is possible to increase isolation between the diversity antenna and other antenna in a limited space, avoid the coupling effect between the antennas, and alleviate the problem present in traditional multiple-input multiple-output antennas limited by the size of the terminal device.

14 Claims, 2 Drawing Sheets

(56) References Cited

FOREIGN PATENT DOCUMENTS

| | | | |
|---|---|---|---|
| CN | 104701623 | A | 6/2015 |
| CN | 105428806 | A | 3/2016 |
| CN | 106571525 | A | 4/2017 |

* cited by examiner

ANTENNA SYSTEM FOR OPTIMIZING ISOLATION AND MOBILE TERMINAL

CROSS-REFERENCE TO RELATED APPLICATIONS

The present application is a 35 U.S.C. § 371 National Phase conversion of International (PCT) Patent Application No. PCT/CN2017/103632 filed on Sep. 27, 2017, which claims foreign priority of Chinese Patent Application No. 201610991317.5, filed on Nov. 10, 2016 in the National Intellectual Property Administration of China, the contents of all of which are hereby incorporated by reference.

TECHNICAL FIELD

The present disclosure relates to the technical field of radio antennas, and particularly to an antenna system for optimizing isolation and a mobile terminal.

BACKGROUND

Wireless multiple-input and multiple-output technology, as one of the key technologies to realize high-speed broadband wireless network access, can satisfy requirements for high transmission rate and extended coverage of future mobile communication, and is widely applied in mobile communication systems. With the development of the mobile terminal technology, the wireless multiple-input and multiple-output technology has increasingly complicated design environment, and is restricted by the appearance and size of the mobile terminal, especially hand-held mobile terminal, such that certain difficulties occur in multi-antenna implementation.

The design of current antennas often involves a need to provide a diversity antenna and a WIFI/BT/GPS antenna within a limited space. When a feed point of the diversity antenna is quite near to a feed point of other antenna, the two antennas will produce a coupling effect and thereby affect performance of the antennas. Therefore, isolation is a key indicator for judging magnitude of mutual influence between antennas. How to coordinate isolation between antenna units and limited size of a mobile terminal device to ensure excellent inter-antenna isolation within a working frequency band in limited environment is a main research issue of multiple antennas of the mobile terminal.

SUMMARY

The technical problem to be solved by the present disclosure is to provide an antenna system for optimizing isolation, which can increase the isolation between antennas.

In order to solve the above-mentioned technical problem, an aspect of the present disclosure provides an antenna system for optimizing isolation. The system includes a circuit board, and the circuit board is provided with: a clearance slot defined in an electromagnetic conductor of the circuit board and between antenna feed points for optimizing isolation between the antenna feed points; and at least two clearance areas disposed on both sides of the electromagnetic conductor having the clearance slot of the circuit board for arranging the antenna feed points. Neither the clearance areas nor the clearance slot contains an electromagnetic conductor.

In order to solve the above-mentioned technical problem, a further aspect of the present disclosure provides a mobile terminal. The mobile terminal comprises a circuit board. The circuit board is provided with: a clearance slot defined in an electromagnetic conductor of the circuit board and between antenna feed points for optimizing isolation between the antenna feed points; and at least two clearance areas disposed on both sides of the electromagnetic conductor having the clearance slot of the circuit board for arranging the antenna feed points. Neither the clearance areas nor the clearance slot contains an electromagnetic conductor.

The present disclosure provides clearance slots between the diversity antenna feed point and other antenna feed point, and provides clearance areas on both sides of the clearance slots, thereby increasing isolation between the antennas in a limited space, avoiding the coupling effect between the antennas, and alleviating the problem present in traditional multiple-input and multiple-output antennas limited by the size of the terminal device.

DETAILED DESCRIPTION

The present disclosure will be described in detail below in conjunction with the accompanying drawings and embodiments.

Figure 1:
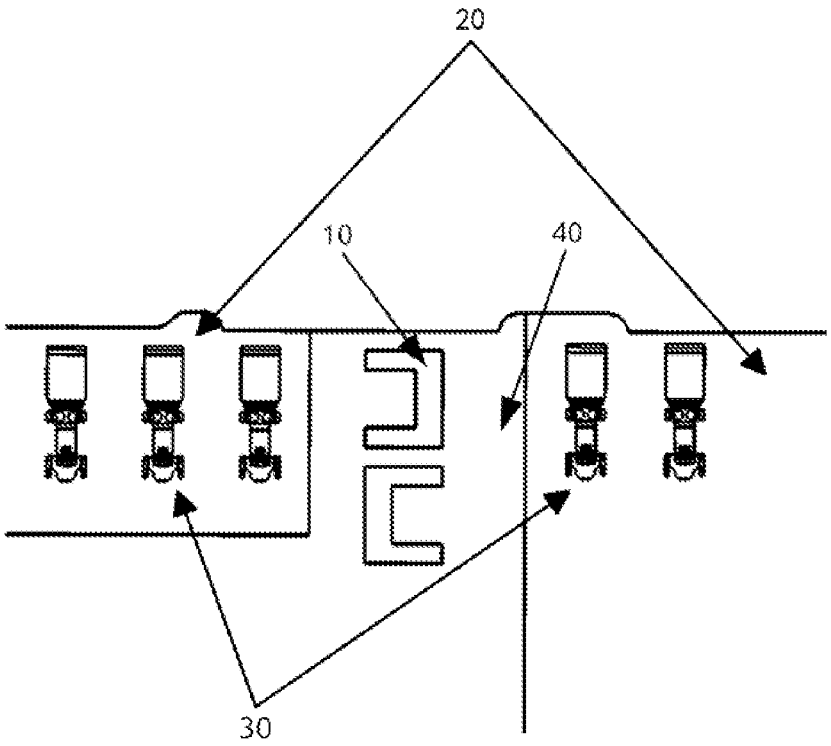
FIG. 1 is a structural diagram of an embodiment of an antenna system for optimizing isolation according to the present disclosure.

Referring to FIG. 1, an antenna system for optimizing isolation according to the present disclosure comprises a circuit board. The circuit board defines clearance slots 10 in an electromagnetic conductor 40 of the circuit board and between antenna feed points 30 for optimizing isolation between antenna units.

In the present embodiment, the clearance slots 10 do not include an electromagnetic conductor. The two clearance slots 10 are inverted mirror slotted matrix, i.e., the two clearance slots 10 form a matrix of slots, and one clearance slot is an inverted mirror image of another clearance slot; and the direction in which the two clearance slots 10 are arranged is perpendicular to a connection line between the antenna feed points 30.

At least two clearance areas 20 are disposed on both sides of the electromagnetic conductor 40 defining the clearance slots 10 of the circuit board for arranging the antenna feed points 30.

In the present embodiment, the clearance areas 20 do not include an electromagnetic conductor. The antenna feed point 30 is a diversity antenna feed point or a WIFI/BT/GPS antenna feed point respectively disposed within the two clearance areas 20. The diversity antenna feed point within one clearance area further includes a plurality of single-antenna feed points. A plurality of single antennas are used for simultaneously transmitting and receiving a plurality of spatial streams, and can make a distinction between signals to or from different spatial orientations. The coupling effect is not considered between the plurality of single-antenna feed points. Therefore, the plurality of single-antenna feed points can be regarded as one diversity antenna feed point, and are arranged within a same clearance area.

The other clearance area includes: a WIFI antenna feed point, wherein the WIFI antenna is used to intensify wireless network signals; a BT antenna feed point, wherein the BT antenna is used to transmit and receive electromagnetic wave energy in wireless communication; and a GPS antenna feed point, wherein the GPS antenna is used to receive satellite positioning signals.

The coupling effect is not considered between the WIFI antenna feed point, the BT antenna feed point and the GPS antenna feed point, either. Therefore, the WIFI antenna feed point, the BT antenna feed point and the GPS antenna feed point can be regarded as one antenna feed point, and are arranged within a same clearance area. Specific positions of the plurality of single-antenna feed points and the WIFI/BT/GPS antenna feed points in the respective clearance areas are configured as actually required and are not defined herein.

Figure 2:
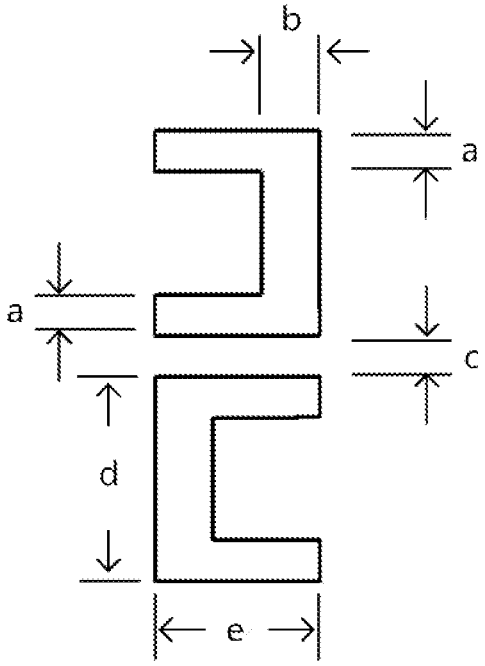
FIG. 2 is a structural diagram showing size of clearance slots of an embodiment of an antenna system for optimizing isolation according to the present disclosure.

Referring to FIG. 2, each of the clearance slots 10 is a rectangle lacking one side, and each width a of two opposite sides of the rectangle is 0.45 to 0.55 mm, preferably, a is 0.5 mm; a width b of one side between the two opposite sides is 0.65 to 0.75 mm, preferably, b is 0.7 mm; and a spacing c between the rectangles is 0.45 to 0.55 mm, preferably c is 0.5 mm. The side with width b is perpendicular to a connection line between the antenna feed points 30.

In the present embodiment, a length d of the rectangle in the clearance slot 10 is 2.45 to 2.55 mm, preferably, d is 2.5 mm; and a width e of the rectangle is 1.95 to 2.05 mm, preferably, e is 2 mm. The specific size and position of the clearance slot 10 are adjusted according to the actual positions and properties of the two antennas. The isolation effect produced by the clearance slot 10 between the two antenna feed points 30 is equivalent to introducing a capacitance or inductance through slotting, thereby creating a stopband to reduce the coupling effect between the two antenna feed points.

The present embodiment provides clearance slots between the diversity antenna feed point and other antenna feed point, and provides clearance areas on both sides of the clearance slots, thereby increasing isolation between the antennas in a limited space, avoiding the coupling effect between the antennas, and alleviating the problem present in traditional multiple-input and multiple-output antennas limited by the size of the terminal device.

Figure 3:
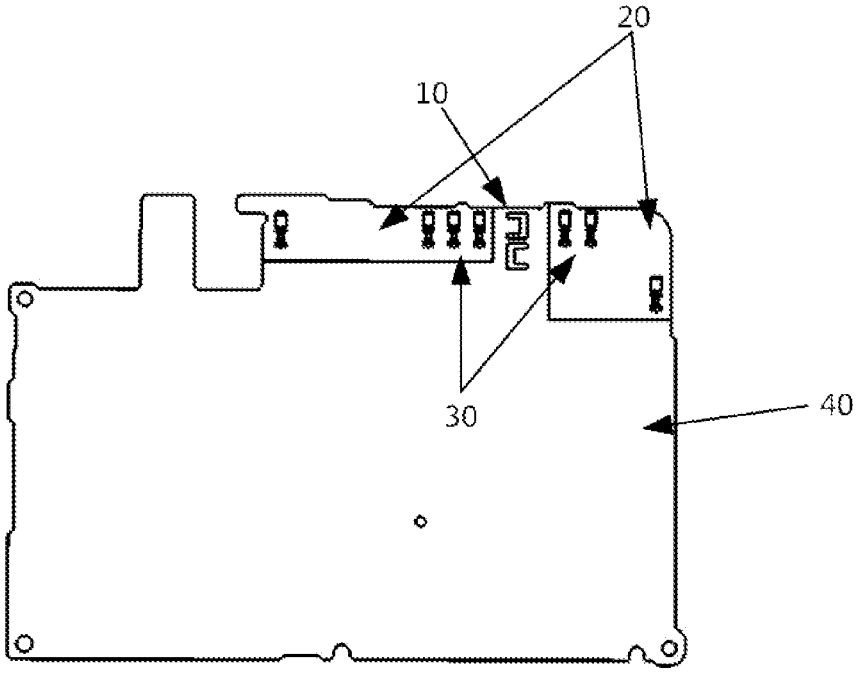
FIG. 3 is a planar structural diagram of an embodiment of a mobile terminal including an antenna system for optimizing isolation according to the present disclosure.
Figure 4:
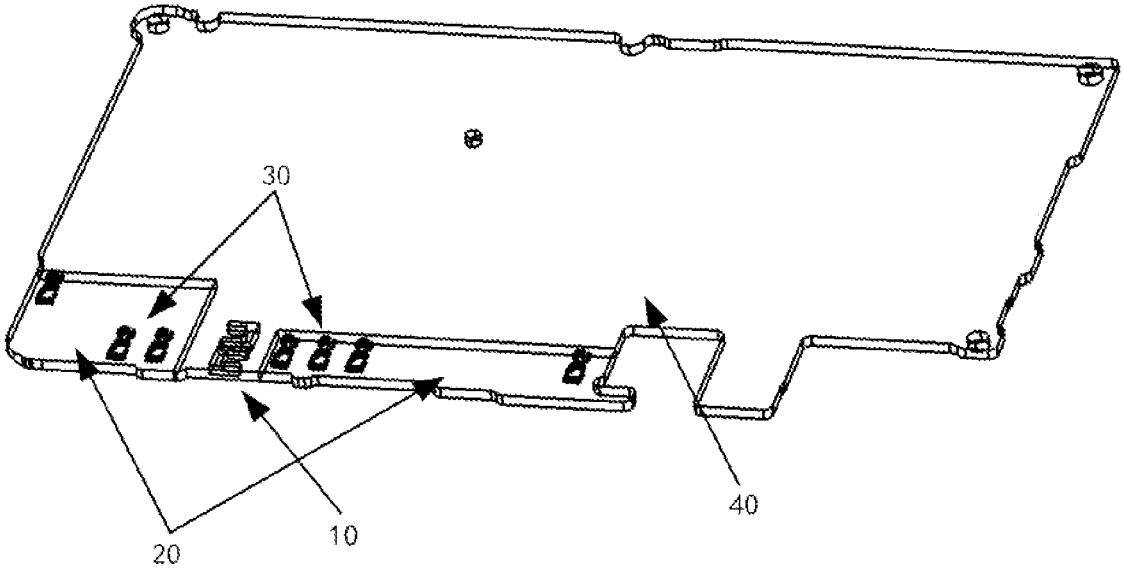
FIG. 4 is a three-dimensional structural diagram of an embodiment of a mobile terminal including an antenna system for optimizing isolation according to the present disclosure.

Referring to FIG. 3 and FIG. 4, the present disclosure provides a mobile terminal which includes a circuit board. The circuit board defines clearance slots 10 in an electromagnetic conductor 40 of the circuit board and between antenna feed points 30 for optimizing isolation between antenna units, and is provided with at least two clearance areas 20 on both sides of the electromagnetic conductor 40 having the clearance slots 10 of the circuit board for arranging the antenna feed points 30.

In the present embodiment, the circuit board is a PCB board comprising an electromagnetic conductor layer and an insulation layer. In practical applications, the size of the PCB board is limited, and it is impossible to increase isolation between the antennas by enlarging physical distance between the antenna feed points. Therefore, in the present embodiment, the clearance slots 10 and the clearance areas 20 are arranged to increase isolation between the antennas. The clearance slots 10 only penetrate through the electromagnetic conductor layer, with the insulation layer remaining. The clearance areas 20 also contain no electromagnetic conductor, with the insulation layer remaining.

In the present embodiment, the positions and sizes of the clearance slot 10 can be referred to the embodiments of the antenna system, and details are not described herein. The clearance areas 20 are divided into one side provided with a diversity antenna feed point and the other side provided with a WIFI/BT/GPS antenna feed point. The specific positions and sizes of the clearance areas 20 are adjusted according to numbers, sizes and positions of the feed points actually included in the diversity antenna feed point or WIFI/BT/GPS antenna feed point. For antennas operating in different frequency bands, the impedance bandwidth of the antennas can be adjusted by reserved antenna matching, feed point position, and slotted size of the clearance slot 10 on the PCB board.

It should be noted that, the mobile terminal in the present embodiment includes, but is not limited to, a mobile phone, and may also be applied to all circumstances where the antenna technology can be applied, for example, wireless access.

The present embodiment provides clearance slots between the diversity antenna feed point and other antenna feed point, and provides clearance areas on both sides of the clearance slots, thereby increasing isolation between the antennas in a limited space, avoiding the coupling effect between the antennas, and alleviating the problem present in traditional multiple-input and multiple-output antennas limited by the size of the terminal device.

The foregoing are only embodiments of the present disclosure, and thus do not limit the patent scope of the present disclosure. Any equivalent structural transformation made by turning to the contents set forth in description and drawings of the present disclosure, or directly or indirectly applied to other related technical fields, shall likewise be included in the scope of the patent protection of the present disclosure.

The invention claimed is:

1. An antenna system for optimizing isolation, wherein the system includes a circuit board, the circuit board being provided with:

a clearance slot defined in an electromagnetic conductor of the circuit board and between antenna feed points for optimizing isolation between the antenna feed points; and at least two clearance areas disposed on both sides of the electromagnetic conductor having the clearance slot of the circuit board for arranging the antenna feed points;

wherein neither the clearance areas nor the clearance slot contains an electromagnetic conductor;

wherein the clearance slot is a rectangle lacking one side, wherein two opposite sides of the rectangle have a same width, and the same width is less than a width of one side between the two opposite sides of the rectangle;

wherein the number of the clearance slot is at least two, and each of the at least two clearance slots is the rectangle lacking one side, any adjacent two rectangles are inverted-mirrored in a direction perpendicular to a direction in which lacked sides of the adjacent two rectangles are located, and a spacing is located between the adjacent two rectangles, such that the at least two clearance slots are in an inverted mirror slotted matrix.

2. The system according to claim 1, wherein the direction in which the at least two clearance slots are arranged is perpendicular to a connection line between the antenna feed points.

3. The system according to claim 1, wherein the same width of the two opposite sides of the rectangle is 0.45 to 0.55 mm, and the width of the one side between the two opposite sides is 0.65 to 0.75 mm, and wherein the spacing between the adjacent two rectangles is 0.45 to 0.55 mm.

4. The system according to claim 1, wherein the antenna feed points comprise a diversity antenna feed point or a WIFI, BLUETOOTH, or GPS antenna feed point.

5. The system according to claim 1, wherein one clearance area on a side of the electromagnetic conductor comprises a diversity antenna feed point, and another clearance area on another side of the electromagnetic conductor comprises a WIFI, BLUETOOTH, or GPS antenna feed point.

6. The system according to claim 1, wherein the clearance slot is defined on an insulation layer, and the clearance areas contain an insulation layer.

7. The system according to claim 1, wherein one side between two opposite sides of one rectangle of the adjacent two rectangles is located at a direct line different from a direct line at which one side between two opposite sides of the other rectangle of the adjacent two rectangles is located.

8. A mobile terminal, wherein the mobile terminal comprises a circuit board, the circuit board being provided with:

a clearance slot defined in an electromagnetic conductor of the circuit board and between antenna feed points for optimizing isolation between the antenna feed points; and at least two clearance areas disposed on both sides of the electromagnetic conductor having the clearance slot of the circuit board for arranging the antenna feed points;

wherein neither the clearance areas nor the clearance slot contains an electromagnetic conductor;

wherein the clearance slot is a rectangle lacking one side, wherein two opposite sides of the rectangle have a same width, and the same width is less than a width of one side between the two opposite sides of the rectangle;

wherein the number of the clearance slot is at least two, and each of the at least two clearance slots is the rectangle lacking one side, any adjacent two rectangles are inverted-mirrored in a direction perpendicular to a direction in which lacked sides of the adjacent two rectangles are located, and a spacing is located between the adjacent two rectangles, such that the at least two clearance slots are in an inverted mirror slotted matrix.

9. The mobile terminal according to claim 8, wherein the direction in which the at least two clearance slots are arranged is perpendicular to a connection line between the antenna feed points.

10. The mobile terminal according to claim 8, wherein the same width of the two opposite sides of the rectangle is 0.45 to 0.55 mm, and the width of the one side between the two opposite sides is 0.65 to 0.75 mm, and wherein the spacing between the adjacent two rectangles is 0.45 to 0.55 mm.

11. The mobile terminal of claim 8, wherein the antenna feed points comprise a diversity antenna feed point or a WIFI, BLUETOOTH, or GPS antenna feed point.

12. The mobile terminal according to claim 8, wherein one clearance area on a side of the electromagnetic conductor comprises a diversity antenna feed point, and another clearance area on another side of the electromagnetic conductor comprises a WIFI, BLUETOOTH, or GPS antenna feed point.

13. The mobile terminal according to claim 8, wherein the clearance slot is defined on an insulation layer, and the clearance areas contain an insulation layer.

14. The mobile terminal according to claim 8, wherein one side between two opposite sides of one rectangle of the adjacent two rectangles is located at a direct line different from a direct line at which one side between two opposite sides of the other rectangle of the adjacent two rectangles is located.

* * * * *